US005527196A

United States Patent [19]

Harkins

[11] Patent Number: 5,527,196

[45] Date of Patent: Jun. 18, 1996

[54] TUBE FISHING FIN ASSEMBLY

[76] Inventor: Robert L. Harkins, 7112 S. Indiana, Oklahoma City, Okla. 73159

[21] Appl. No.: 495,777

[22] Filed: Jun. 27, 1995

[51] Int. Cl.[6] ..... A63B 31/11

[52] U.S. Cl. ..... 441/61; 441/64

[58] Field of Search ..... 441/55, 59, 60, 441/61, 62, 63, 64

[56] References Cited

U.S. PATENT DOCUMENTS

| | | | |
|---|---|---|---|
| 2,276,082 | 3/1942 | Meyers | 441/109 |
| 2,557,367 | 6/1951 | Wenke | 441/63 |
| 3,068,499 | 12/1962 | Biskupsky | 441/63 |
| 3,432,868 | 3/1969 | Lowery | 9/343 |
| 4,664,639 | 5/1987 | Schneider | 441/61 |
| 5,338,275 | 8/1994 | Chek | 441/61 |

*Primary Examiner*—Stephen Avila
*Attorney, Agent, or Firm*—Robert K. Rhea

[57] ABSTRACT

A tube fishing reversible footwear fin having a tongue end portion projecting beyond a user's footwear is formed by a generally rectangular planar fin pivotally attached intermediate its ends to the bottom surface of the sole of a boot binding for angular rotation in either direction relative to the sole about a vertical pivoting axis. Indexing pins depending from the sole and releasably nested by an index aperture in the fin permit a user to manually rotate the fin 180° in either direction while supported by a float tube to dispose the elongated tongue end portion of the fin forwardly or rearwardly of his footwear and move forwardly or backward, as desired.

2 Claims, 2 Drawing Sheets

TUBE FISHING FIN ASSEMBLY

BACKGROUND OF THE INVENTION

1. Field of the Invention

This invention relates to tube fishing and more particularly to reversible fins for moving a fisherman forwardly or rearwardly in water.

Tube fisherman utilize chest high wadding boots and sit in a strap or fabric cradle supported by a pneumatic tube of sufficient buoyancy to support the fisherman adjacent the surface of a body of water. While fishing, wind often moves the fisherman toward or away from a spot where fish are biting. It is highly desirable to provide a pair of fins which may be attached to the footwear of a fisherman and be reversed, while in the water, for moving the fisherman toward or away from a spot where fish are biting. This invention provides such an apparatus.

2. Description of the Prior Art

Foot fins have been used for many years by swimmers or scuba divers for propelling themselves through the water and usually comprise a wide fin of flexible material which extends forwardly from the user's foot so a swimming action creates a forward force for moving the swimmer or diver. However, when such a fin is used by a person vertically positioned in the water, as when tube fishing, forward and rearward movement of the fin causes the fisherman to be moved backward rather than forward. Such motion is undesirable in tube fishing since the fisherman cannot be sure where he is moving too.

U.S. Pat. No. 4,664,639 issued May 12, 1987 to Schneider for TUBE FISHERMAN'S FOOT FIN discloses an elongated fin formed from resilient material having one end portion attached to the toe end of a shoe sole so that forward movement of the foot positions the fin adjacent the shoe sole and offers little resistance to forward movement through the water. Rearward movement of foot and shoe results in maximum resistance to the water thereby propelling the fisherman forwardly through the water.

U.S. Pat. No. 2,276,082 issued Mar. 10, 1942 to Meyers for BOOT BOAT and U.S. Pat. No. 3,432,868 issued Mar. 18, 1969 to Lowery for FLOAT-EQUIPPED WADING BOOTS WITH PROPELLING FINS are good examples of the further state-of-the-art. Both of these patents disclose fin members attached vertically to the outer surface of a user's wading boot so that in forward movement of the leg the fin is collapsed toward the leg and offers little resistance to forward movement of the leg in water but upon rearward movement of the leg the fin opens in pocket like fashion to resist movement rearwardly in the water, thus, propelling the user forwardly. However, neither of the these patents or the Schneider patent disclose or provide means for reversing the water resisting action of the fins, while the user remains in the water, in order to propel a user in a forward or backward direction which is accomplished by this invention.

SUMMARY OF THE INVENTION

An elongated generally planar fin is pivotly connected intermediate its ends with the sole portion of a boot binding for projecting forwardly or rearwardly from the respective ends of the boot binding.

One end portion of the fin is transversely widened and cupped to resist movement thereof through water. The other end portion of the fin projects laterally at respective sides beyond the lateral limits of the boot binding to be engaged by the an end portion of the fin on the other foot of a user for deflecting the end portion of the fin, opposite its transversely wide cup portion, downwardly for indexing the fin on index pin end portions depending from the sole of the boot binding by angularly rotating the fin 180° in either direction about the vertical axis of its pivot point.

The principal object of this invention is to provide fishing float fins removably connected with the footwear of a fisherman which may be angularly rotated 180° by the fisherman while in the water for disposing the water engaging end portion of the respective fin in either a forward or rearward direction from the user's footwear and propelling himself forwardly or rearwardly as desired.

DESCRIPTION OF THE PREFERRED EMBODIMENTS

Figure 1:
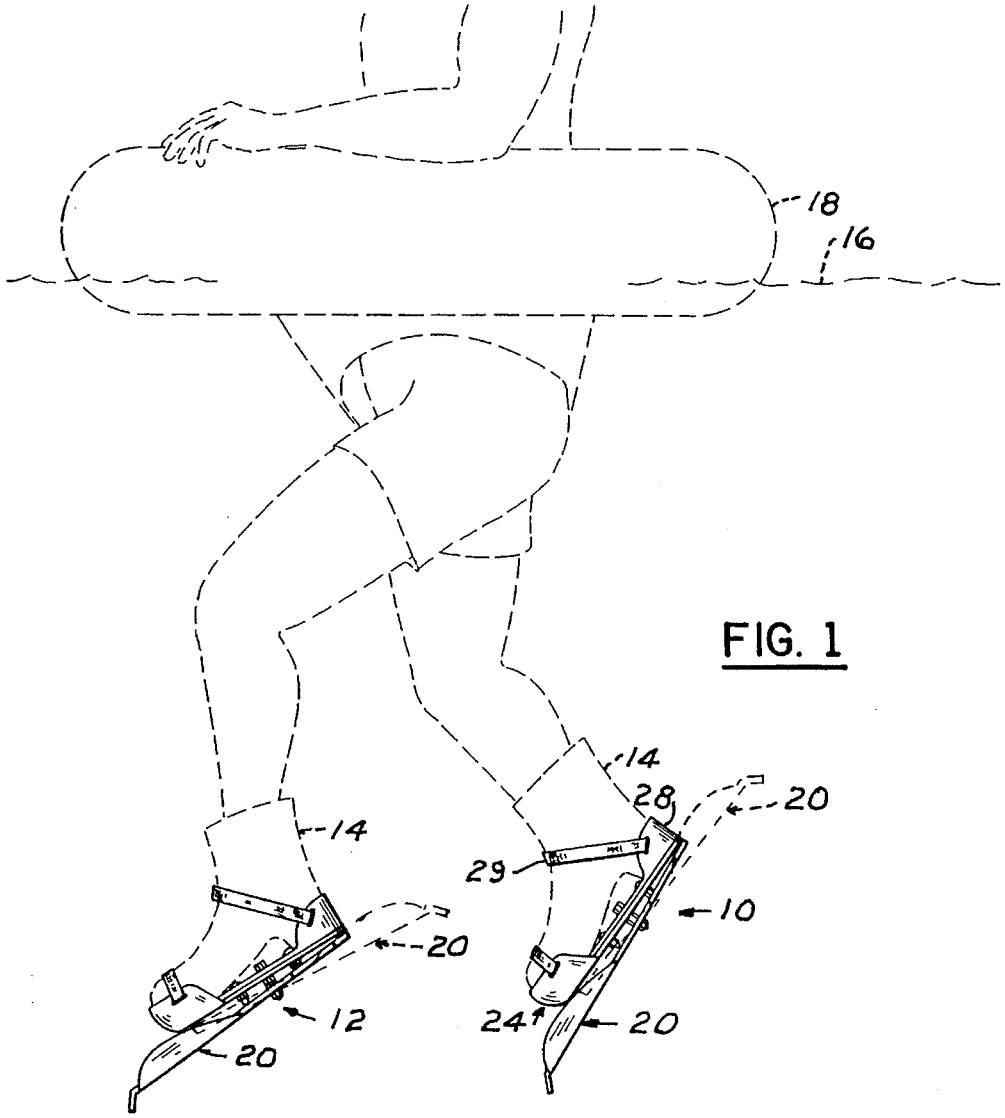
FIG. 1 is a side elevational view, illustrating by dotted lines, the position of a user supported by a fishing float.

Like characters of reference designate like parts in those figures of the drawings in which they occur.

The reference numerals 10 and 12 respectively indicate fishing float fin assemblies respectively secured to the footwear 14 of a user supported in an upright position in a body of water 16 by a pneumatic tube 18. Since the assemblies 10 and 12 are identical only the assembly 12 will be described in detail.

The fin assembly 10 comprises an elongated generally rectangular planar member or fin 20 preferably formed from a material such as plastic for the reason presently explained. The fin 20 is pivotly connected intermediate its ends by a pivot pin assembly 22 to the sole portion of a boot binding 24.

The boot binding 24 comprises an upper sole 26 of uniform width having an arcuate upstanding wall 28 at one end portion forming a heel socket provided with an ankle strap and buckle 29 for connecting the boot binding to a user's footwear. A lower or bottom sole 30 longitudinally underlies the top sole 26 and is provided with a toe portion of greater transverse width than the remainder of the sole, similarly having an upstanding arcuate wall 32, provided with a fastening strap and buckle 33 for securing the boot binding to the toe portion of a user's footwear. With the upper and lower soles superposed, a pair of longitudinally spaced holes 34 and 35 are line drilled through the two soles for respectively receiving index pins 36 and 38 having washers and nuts including acorn lock nuts 36' and 38' for the purpose presently explained and securely joining the two soles together.

The fin 20 is formed from a selected material capable of being longitudinally deflected downwardly at one end portion (FIG. 2) and returning to a position of repose planar with the remainder of the fin. The fin 20 is characterized by parallel side edges 40 defining a width projecting a selected distance beyond the respective side of the boot binding soles. Between its rearward end portion 41, as viewed in FIGS. 1 and 2, terminating in a transverse arcuate curve 42 and the rearward limit of the side edges 40, the end portion 41 is provided with opposite ubstantially semicircular wing portions 46 projecting laterally of the fin portion 41 substantially half the width of the boot binding soles, for the purpose presently explained. The fin opposite cup-like tongue end portion 43 terminates in a transverse down turned lip 44.

Between the forward lip 44 and respective side edge 40, the tongue end portion is extended laterally to define opposite longitudinal arcuate edge portions 48 which are disposed angularly upward and outward, as viewed in the drawings, for increasing water resistance against the top surface of the fin tongue portion and define a planar width between the upturned portions 48 at least equal to the transverse distance between the lateral outer limit of the wings 46.

The boot binding soles are superposed and longitudinally disposed on the fin 20 with the vertical plane of the heel or toe end wall substantially coinciding with the heel arcuate curve 42. The superposed soles and fin are line drilled as at 50, 50', and 50" for receiving the pivot pin assembly 22.

Figure 2:
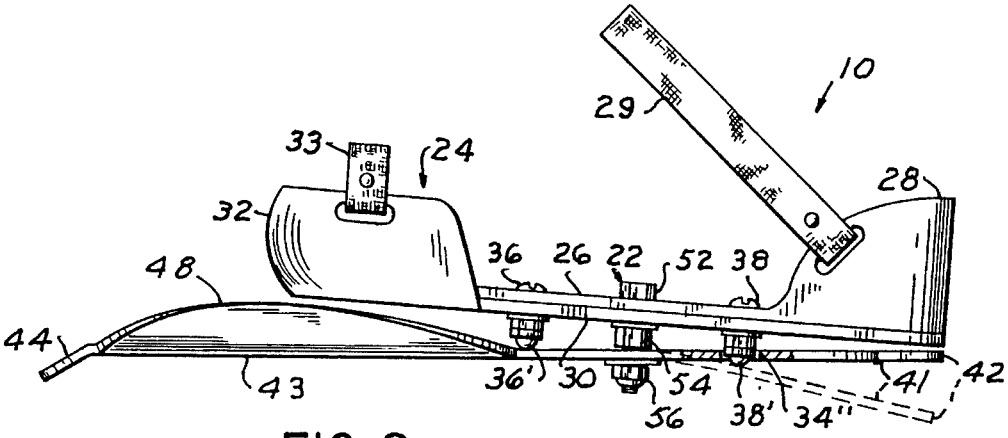
FIG. 2 is a side elevational view, to a larger scale of one of the devices.
Figure 3:
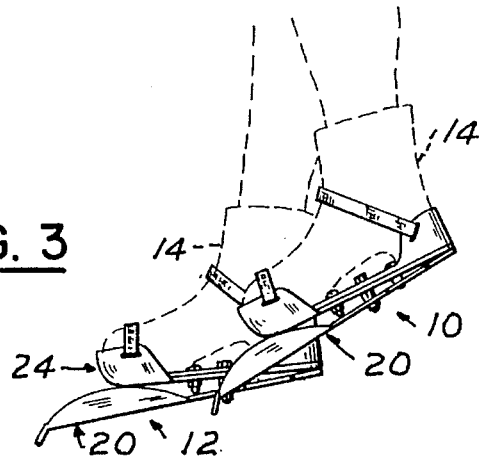
FIG. 3 is a side elevational view, similar to FIG. 1, illustrating the manner of releasing one of the fins for a 180° pivoting action; and, FIG. 4 is an exploded perspective view, illustrating by dotted lines, a reversed position of the fin.

The pivot pin assembly 22 comprises a stud bolt 52 and nut and washer 54 similarly securing the upper and lower soles 26 and 30 together. The depending end portion of the stud bolt, projects below the lower limit of the fin 20 and loosely through its aperture 50", for receiving a second washer and lock nut 56 which are disposed in spaced relation with respect to the nut 54 for the purpose of allowing the plane of the fin to be angularly disposed with respect to the plane of the sole 30 (FIG. 2). As shown by FIG. 2, the acorn nut 38' is disposed in the fin bore 34" and the acorn nut 36' contacts the top surface of the fin forwardly of its pivot pin receiving bore 50".

Operation

In operation, assuming the fishing fins 10 and 12 have been assembled as described hereinabove and attached to the user's shoes or boots 14 in the position shown by FIGS. 1 and 2, walking action of a user's legs moves the float supported user in a backward direction.

Figure 4:
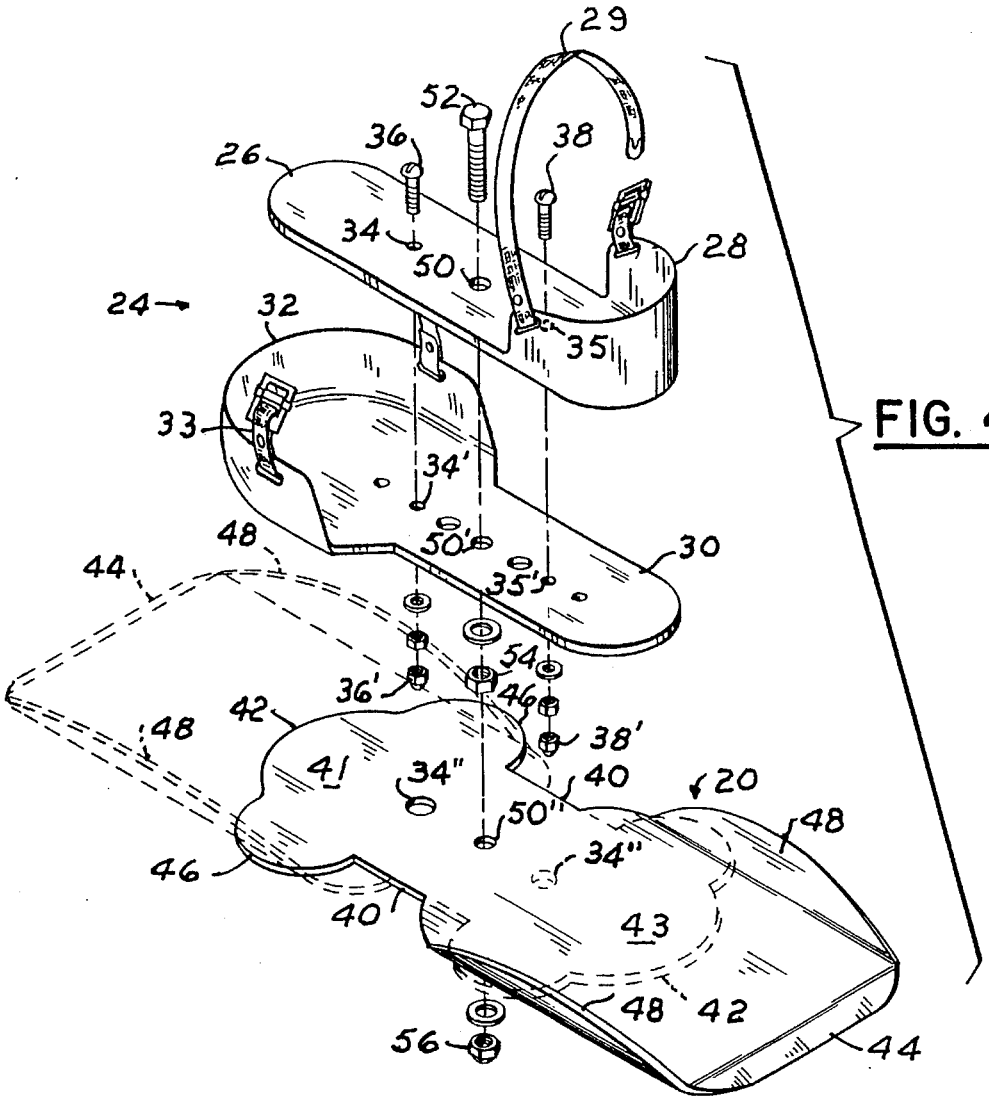

For moving forwardly, the user places the tongue portion 43 or one of the end portion 41, for example, of the fin assembly 10 on the fin assembly 12 laterally projecting wing portions 46 on the other foot to force the fin end portion 41 of the fin assembly 12 downwardly, as illustrated by dotted lines (FIG. 2), and separate the fin aperture 34" from the acorn nut 38' and angularly rotate the fin 180° about the axis of the pin assembly 22 and position the tongue end portion of the fin in the rearward direction, as illustrated by solid lines (FIG. 4), and the fin aperture 34" nesting the acorn nut 36'.

This action is repeated for the fin on the assembly 10. With both the fin tongue portions 43 projecting rearwardly of a user's boot binding heel portion, as illustrated by dotted lines (FIG. 1), a walking action of the user's legs moves him forwardly in the water.

Obviously the invention is susceptible to changes or alterations without defeating its practicability. Therefore, I do not wish to be confined to the preferred embodiment shown in the drawings and described herein.

I claim:

1. A reversible fin assembly for a float tube fisherman, comprising:

boot binding means including a sole having strap equipped shoe heel and toe walls at respective ends of the sole for attachment with footwear worn by a user;

an elongated generally planar fin having opposing end portions and having a width and length greater than said sole and pivotally connected with said sole in longitudinal underlying relation for angular rotation about a vertical axis in either direction of the fin relative to the sole and projecting, at one end portion, beyond said sole, said fin being characterized by substantially semicircular wing portions extending laterally of the other heel end portion for underlying the heel or toe end portion of the fin on the other foot and manually angularly rotating said last named fin 180°; and, indexing means including indexing pins extending through said sole in longitudinally equally spaced relation with respect to the vertical pivoting axis, said fin having a cooperating index pin receiving aperture in said other end portion for selectively positioning said fin toe end portion beyond the heel or toe end of the sole.

2. The fin assembly according to claim 1 in which said fin one end portion is characterized by lateral outward and angularly upward inclined side walls.

* * * * *